United States Patent [19]

Shiotsubo et al.

[11] Patent Number: 4,487,525

[45] Date of Patent: Dec. 11, 1984

[54] PROPULSION PIPE LAYING SYSTEM

[75] Inventors: Masami Shiotsubo, Hiratsuka; Toshikazu Yamamuro, Odawara; Hiroshi Saito, Hiratsuka, all of Japan

[73] Assignee: Kabushiki Kaisha Komatsu Seisakusho, Tokyo, Japan

[21] Appl. No.: 524,217

[22] Filed: Aug. 18, 1983

[51] Int. Cl.[3] ..... F16L 1/02

[52] U.S. Cl. ..... 405/184; 175/62; 405/248

[58] Field of Search ..... 405/184, 141, 138, 248, 405/249; 299/56; 175/62, 61, 53, 73; 254/29 R

[56] References Cited

U.S. PATENT DOCUMENTS

| | | | |
|---|---|---|---|
| 3,356,167 | 12/1967 | Trent | 175/62 X |
| 3,526,285 | 9/1970 | Adkins et al. | 175/62 X |
| 3,635,036 | 1/1972 | Hooper | 405/184 X |
| 3,767,836 | 10/1973 | Geis et al. | 175/62 X |
| 3,845,828 | 11/1974 | Taylor et al. | 175/62 X |
| 4,091,631 | 5/1978 | Cherrington | 175/62 X |
| 4,226,477 | 10/1980 | Capoccia | 299/56 |

*Primary Examiner*—Dennis L. Taylor

*Attorney, Agent, or Firm*—Armstrong, Nikaido, Marmelstein & Kubovcik

[57] ABSTRACT

A propulsion-jack driven pipe laying system including a pilot head having a cutter mounted at the leading end thereof and a propulsion-jack mounted in a pit behind the pilot head for propelling the same into the underground. The system further includes a water supply pipe and a slurry discharge pipe both mounted to the pilot head. Earth and sand excavated by the cutter is introduced into a receiving chamber where it is mixed with water supplied through the water pipe and converted into a slurry and the slurry is discharged through the slurry discharge pipe.

In one embodiment, a flowmeter is disposed in a slurry conduit connected with the slurry discharge pipe for detecting flow rate of the slurry and controlling the restriction rate of a valve disposed in the slurry conduit. In another embodiment, a differential pressure detector is mounted within underground pressure at the cutter and a pressure in the receiving chamber and controlling the restriction rate of a valve disposed in the slurry circuit.

8 Claims, 4 Drawing Figures

PROPULSION PIPE LAYING SYSTEM

BACKGROUND OF THE INVENTION

This invention relates to a propulsion pipe laying system for small diameter pipes.

This pipe laying system is constructed such that the earth and sand is excavated by a cutter of a pilot head of a pipe propulsion machine and the excavated earth and sand is introduced through an opening of the cutter into an earth and sand receiving chamber formed in the pilot head while pressurized water is supplied through a water supply pipe into the chamber to convert the earth and sand therein into a slurry state to thereby enable the earth and sand to be discharged through a slurry discharge pipe. The discharged slurry is sent into a receiving tank from which it is returned by a pump into a water supply tank and is then recycled. The basic idea of the propulsion-jack driven pipe laying system is disclosed in U.S. Pat. Nos. 4,020,641; 4,024,721 and 4,026,371 all assigned to common assignee of this application and contents therein are incorporated herein by reference.

When the land to be excavated contains a large volume of underground water and has a good water permeability and if the land is sandy, the underground water pressure $P_1$ in the front area of the excavation cutter urges the external water together with earth and sand to flow into the earth and sand receiving chamber of the pilot head. Consequently, the slurry discharge quantity $Q_2$ becomes greater than the water supply quantity $Q_1$.

Stating in brief, if the underground water pressure $P_1$ increases to a certain level, it becomes higher than the pressure loss through the slurry discharge pipe. Whilst, the pressure $P_2$ within the earth and sand receiving chamber is nearly the same as the pressure loss created through the slurry discharge pipe, and therefore the underground water pressure $P_1$ becomes higher than the pressure $P_2$. In consequence, water accompanied by earth and sand flows into the earth and sand receiving chamber through the opening of the excavating cutter, and so the slurry discharge quantity $Q_2$ exceeds the water supply quantity $Q_1$.

As a result of this phenomenon, earth and sand in volume of more than the excavated space is discharged thus forming a big cavity around the excavating cutter.

Thus, the earth and sand above the excavated space tends to fall in and as a result it becomes impossible to correct downwardly the direction of movement of the pilot head thus causing its upward movement.

Another disadvantage of the conventional propulsion pipe laying system resides in that, when the pipe propulsion is suspended and the buried pipe is extended, the water supply pipe and the slurry discharge pipe installed on the side of a pit are detached from those pipes on the side of the pilot head, and therefore the underground water flows through the water supply and slurry discharge pipes into the pit. The outflow of the underground water sweeps away part of the underground earth and sand with the result that the earth and sand may deposit in the water supply and slurry discharge pipes.

In such a case, when restarting the excavation, earth and sand may clog the slurry discharge pipe, and so it is impossible to discharge slurry. Because of a high internal pressure prevailing therein, the water supply pipe can send the deposited earth and sand into the earth and sand receiving chamber, however, there may be a problem of clogging of the pipe as well.

SUMMARY OF THE INVENTION

It is therefore an object of the present invention to provide a propulsion-jack driven pipe laying system which overcomes the above noted problems of the prior art.

Another object of the present invention is to provide a propulsion-jack driven pipe laying system which can prevent a pit face from being caved-in by equalizing flow rate of a slurry being discharged to that of water being introduced through a water supply pipe.

A further object of the present invention is to provide a propulsion-jack driven pipe laying system which can prevent a pit face from being caved-in by equalizing a pressure in a receiving chamber to the underground pressure.

A still further object of the present invention is to provide a propulsion-jack driven pipe laying system which can effectively prevent a slurry pipe from being clogged.

In accordance with an aspect of the present invention, there is provided a propulsion pipe laying system including a pilot head having cutter means mounted at the leading end thereof and means for propelling said pilot head into the underground, comprising: water supply pipe means mounted to said pilot head; slurry discharge pipe means mounted to said pilot head; a first tank containing water therein; pump means for pumping water from said first tank and supplying the same to said water supply pipe means; a second tank for receiving a slurry from said slurry discharge pipe means; slurry conduit means connected to said slurry discharge pipe means for carrying the slurry to said second tank; means for defining a receiving chamber in a leading end portion of said pilot head for receiving excavated earth and sand therein, said receiving chamber being communicated with leading ends of both said water supply pipe means and said slurry discharge pipe means; flowmeter means mounted in said slurry conduit means for detecting flow rate of the slurry; valve means disposed in said slurry conduit means for restricting flow rate of the slurry therethrough when actuated; and a controller responsive to the flowmeter means for controlling the rate of restriction of said valve means in such a way that flow rate of the slurry becomes about equal to that of water supplied to said water supply pipe means.

In an alternative embodiment, a differential pressure detector means is employed instead of using a flowmeter means. In order to prevent the slurry discharge pipe means or water supply pipe means from being clogged, a pinch valve may be mounted in the slurry discharge pipe means or water supply pipe means.

The above and other objects, features and advantages of the present invention will be readily apparent from the following description taken in conjunction with the accompanying drawings.

DESCRIPTION OF THE PREFERRED EMBODIMENTS

Figure 1:
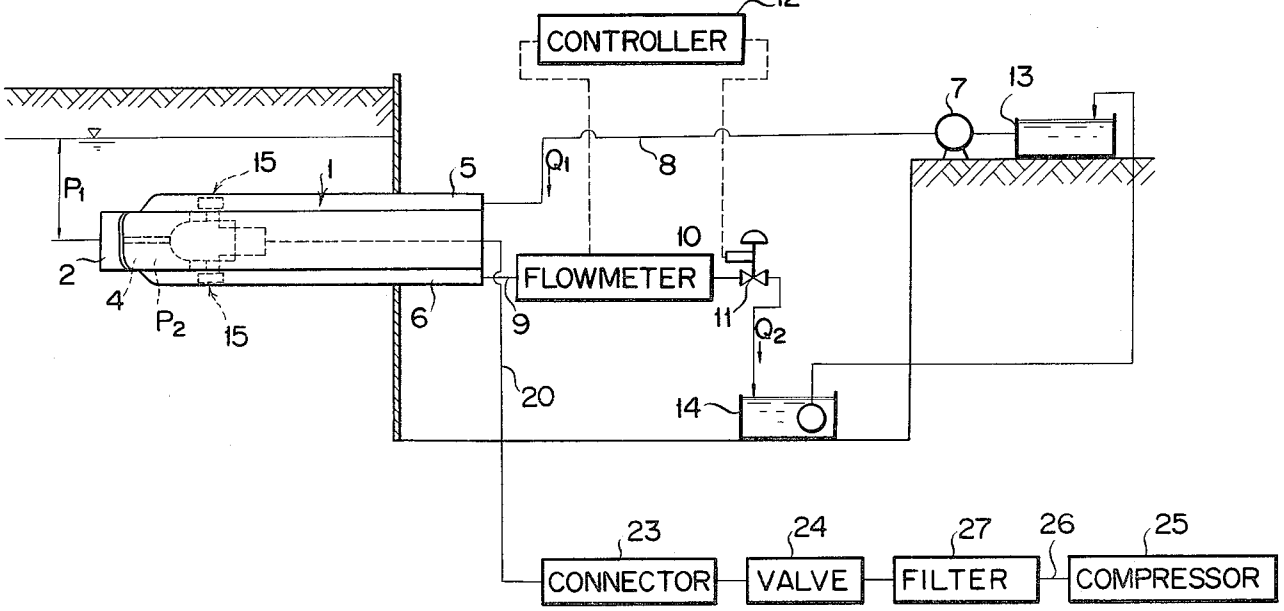
FIG. 1 is a diagramatic representation of a propulsion pipe laying system according to the present invention.
Figure 2:
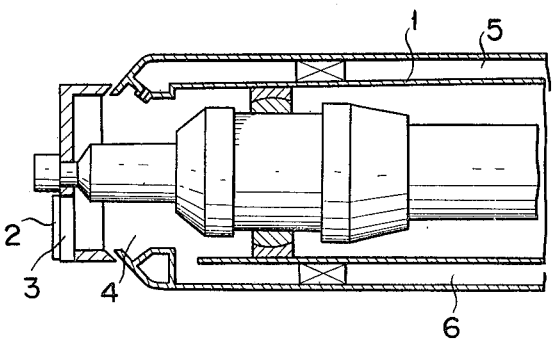
FIG. 2 is an enlarged longitudinal sectional view of the leading end portion of a pilot head.

The present invention will now be described below by way of example only with reference to the accompanying drawings.

In the drawings, reference numeral 1 denotes a pilot head of a propulsion machine. The pilot head comprises a cutter 2, a chamber 4 adapted to receive the excavated earth and sand which is forced therein through an intake port of the cutter 2, a water supply pipe 5 communicating with the chamber 4, and a slurry discharge pipe 6 also communicating with the chamber 4. The water supply pipe 5 is connected through a connector not shown with a water supply pipe 8 installed on the delivery side of a pump 7. Whilst, the slurry discharge pipe 6 is connected through a slurry discharge pipe 9 to a tank 14.

Although not specifically illustrated in the drawings, a propulsion-jack is installed in the pit and the pilot head 1 is propelled or driven in the underground by the propulsion-jack.

Installed in the slurry discharge pipe 9 are a flowmeter 10 and a control valve 11. The arrangement is made such that a detection signal generated by the flowmeter 10 is sent to a controller 12, the output signal produced by the controller 12 controlling the control valve 11.

Thus, rotation of the cutter 2 excavates earth and sand, and the excavated earth and sand are forced into the receiving chamber 4 and then changed into a slurry state by the action of the water supplied through the water supply pipe 5, the resultant slurry being discharged through the slurry discharge pipes 6 and 9. During the time, the slurry discharge quantity $Q_2$ is measured or detected by the flowmeter 10 and a detection signal generated by the flowmeter 10 is sent to the controller 12, the output signal of which controls the control valve 11 so that the slurry discharge quantity or return flow rate $Q_2$ may be kept approximately equal to the water supply quantity $Q_1$.

Stating in more detail, the pressure $P_2$ in the receiving chamber 4 is controlled from the outside, and so a pressure loss will occur by restricting the control valve 11.

If we put $P_2=\Delta P+Kl(Q_2)^2$ wherein, $\Delta P$ is a pressure loss across the valve, $Kl(Q_2)^2$ is a pressure loss across the pipeline, where $$C_v=\frac{1.17Q_2}{\sqrt{\Delta P}},$$

and l is the length of the pipeline;

we obtain $$P_2=\left[\frac{(1.17)^2}{(C_v)^2}+Kl\right]\times(Q_2)^2$$

Because the value of $C_v$ varies with the degree of opening of the control valve, if the control valve 11 is closed, then $\Delta P$ will increase resulting in an increase in pressure $P_2$. In this way the pressure $P_2$ in the receiving chamber 4 can be controlled.

It is to be understood that, if $P_1$ is kept equal to $P_2$ to eliminate the pressure differential therebetween, then the flow of water as well as earth and sand from the natural ground into the receiving chamber 4 will discontinue.

The detection of the pressure differential between $P_1$ and $P_2$, however, requires assembly of a differential pressure measuring instrument into the pilot head 1, and therefore a best result can be obtained by measuring the return flow rate $Q_2$ and shutting off the control valve 11 until the return flow rate $Q_2$ becomes approximately equal to the water supply quantity $Q_1$.

For this reason, if $Q_1$ becomes equal to $Q_2$, then $P_1$ becomes equal to $P_2$ thus enabling the soil excavation to be conducted at the theoretical excavation quantity. Further, if the opening degree of the control valve 11 is increased, then the quantity of earth and sand to be excavated will increase beyond the theoretical value, whilst the opening degree of the valve 11 is reduced, the quantity of earth and sand to be excavated will become less than the theoretical value.

Thus, if and when the slurry discharge quantity $Q_2$ is kept equal to the water supply quantity $Q_1$, then it is possible to take out the earth and sand in volume equivalent to the theoretical value. Therefore, it is only necessary to control the control valve 11 manually or automatically while monitoring the flowmeter 10 to thereby ensure that the slurry discharge quantity $Q_2$ becomes equal to the water supply quantity $Q_1$. Moreover, if the water supply quantity $Q_1$ is set equal to the slurry discharge quantity $Q_2$, then the supplied water is recycled so that the liquid level in the water supply tank 13 may be kept constant. Accordingly, controls of the opening degree of the control valve 11 while monitoring the liquid level in the water supply tank 13 enables the water supply quantity $Q_1$ to be kept equal to the slurry discharge quantity $Q_2$. When the concentration of the slurry is high, it is only necessary to make adjustments so as to obtain a relationship expressed by the following formula.

$$Q_2=Q_1+q$$

wherein q is a volumetric excavation flow rate (l/min), and its value is generally a few percents of $Q_1$ and is therefore negligible.

Further, the volumetric excavation flow rate q can be obtained by the product of the sectional area S of the cutter 2 of the pilot head 1 and the propulsion speed V.

Figure 3:
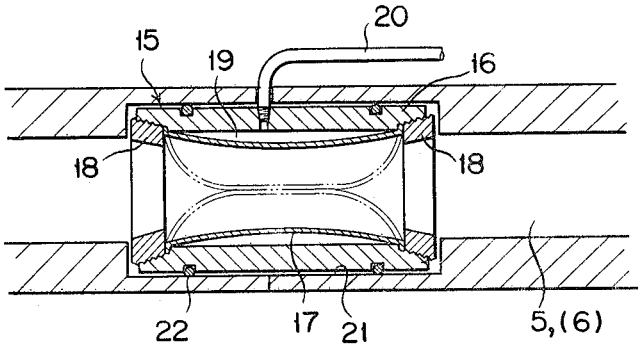
FIG. 3 is an enlarged sectional view of a pinch valve installed in a water supply pipe or slurry discharge pipe.

Further, according to the pipe laying system of the present invention, each of the water supply pipe 5 and the slurry discharge pipe 6 has a pinch valve 15 installed therein. As shown in FIG. 3, the pinch valve 15 comprises an outer cylinder 16 in which is inserted a resilient cylinder 17 of a resilient material such as, for example, rubber, and both ends of the cylinder 17 are secured to the outer cylinder 16 by means of ring members 18 fitted in both ends of the outer cylinder 16. Defined between the outer cylinder 16 and the resilient cylinder 17 is an air charging chamber 19. Connected to the outer cylinder 16 is an air conduit 20 adapted to supply pressurized air into the air charging chamber 19 and exhaust it therefrom. A fluid such as, for example, water and oil etc. may be used instead of air. The pinch valve thus constructed is installed in a mounting portion 21 in the inner peripheries of the water supply pipe 5 and slurry discharge pipe 6 through "O" rings 22. The mounting portion 21 should preferably be located, if possible, close to the earth and sand receiving chamber 4. The air conduit 20 of the pinch valve 15 is connected through a connector 23 to the outlet side of a pressure reducing valve 24, and the inlet side of the pressure reducing valve 24 is connected to a discharge pipe 26 of a compressor 25. The discharge pipe 26 is provided with a filter 27.

Thus, during propulsion of the pipe into the underground, air is not supplied into the pinch valve 15. Therefore, the resilient cylinder 17 of the pinch valve 15 is kept open as shown by solid lines in FIG. 3 so as to communicate the water supply pipe 5 and the slurry discharge pipe 6 with the receiving chamber 4. During connection of buried pipes, air (at a pressure of 2 to 3 $kg/cm^2$) is supplied into the air charging chamber 19 of the pinch valve 15 to inflate the resilient cylinder 17 as shown by dotted lines in FIG. 3 to close it thereby blocking the connection of the water supply pipe 5 and/or the slurry discharge pipe 6.

Then, the air conduit 20 is disconnected from the pressure reducing valve 24 by means of the connector 23 which is adapted to be closed when it is disconnected thus keeping the conduit 20 pressurized.

When the pinch valve 15 is closed, the resilient cylinder 17 is kept into surface contact and closed tightly thereby blocking completely the water supply pipe 5 and the slurry discharge pipe 6. As a result, neither underground water nor earth and sand flows through the pipes 5 and 6. Further, even if a small amount of earth and sand enter the resilient cylinder 17, its function of stopping water can be maintained.

Figure 4:
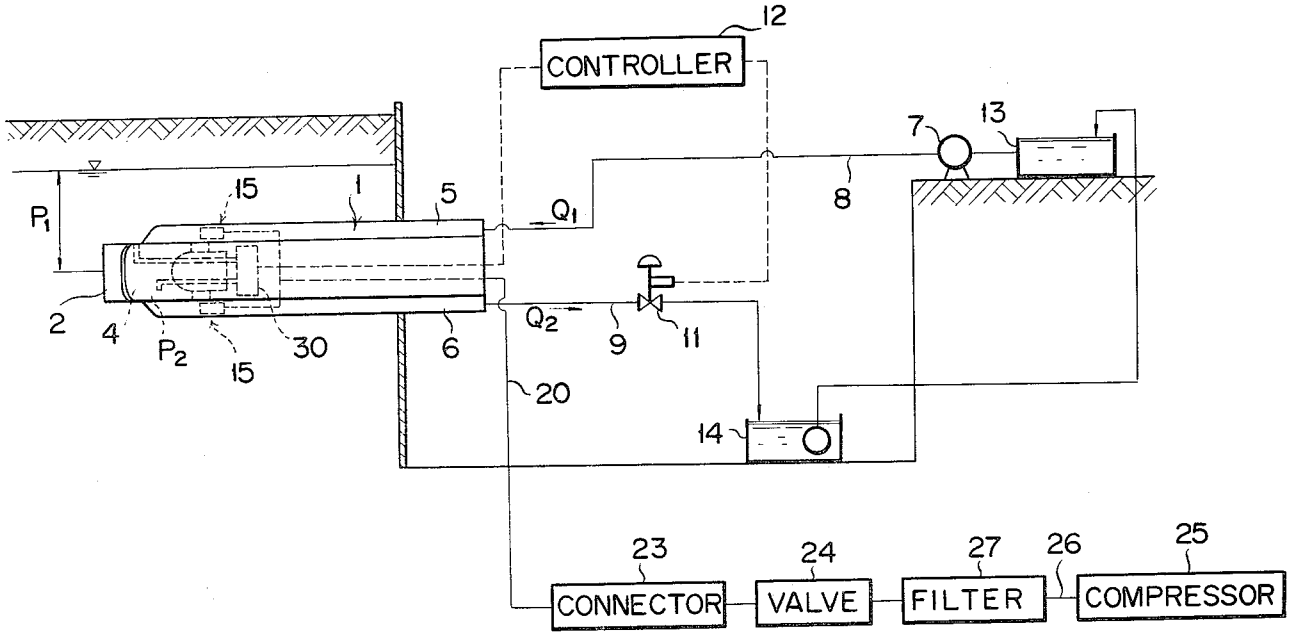
FIG. 4 is similar to FIG. 1 but showing another embodiment of the present invention.

FIG. 4 shows another embodiment of the present invention which differs from the abovementioned embodiment in that a differential pressure detector 30 is installed in the pilot head. The difference between the underground water pressure $P_1$ and the pressure $P_2$ in the receiving chamber 4 is detected by the differential pressure detector 30, the detection signal of which is sent to the controller 12.

The signal generated by the controller 12 controls or close the control valve 11 so as to obtain the relationship $P_1=P_2$ thereby keeping the slurry quantity $Q_2$ equal to the water supply quantity $Q_1$.

Since the present invention is constructed as mentioned in detail hereinabove, the return flow quantity $Q_2$ can be kept equal to the water supply quantity $Q_1$ by controlling the opening degree of the control valve 11; the earth and sand of a quantity equivalent to a theoretical quantity can be excavated; the fall of working face can be eliminated; corrections of the direction of advancement of the pilot head can be made easily; and sinking of land can be prevented.

Further, according to the present invention, when extension of buried pipe is made, the slurry discharge pipe 6 can be closed by means of the pinch valve 15 so that entry of external earth and sand into the slurry discharge pipe 6 can be prevented whereby clogging of the slurry pipe when restarting the propulsion can be prevented.

It is to be understood that the foregoing description is merely illustrative of the preferred embodiments of the invention and that the invention is not to be limited thereto, but is to be determined by the appended claims.

What is claimed is:

1. A propulsion pipe laying system including a pilot head having cutter means mounted at the leading end thereof and means for propelling said pilot head into the underground, comprising:

water supply pipe means mounted to said pilot head;

slurry discharge pipe means mounted to said pilot head;

a first tank containing water therein;

pump means for pumping water from said first tank and supplying the same to said water supply pipe means;

a second tank for receiving a slurry from said slurry discharge pipe means;

slurry conduit means connected to said slurry discharge pipe means for carrying the slurry to said second tank;

means for defining a receiving chamber in a leading end portion of said pilot head for receiving excavated earth and sand therein, said receiving chamber being communicated with leading ends of both said water supply pipe means and said slurry discharge pipe means;

flowmeter means mounted in said slurry conduit means for detecting flow rate of the slurry;

valve means disposed in said slurry conduit means for restricting flow rate of the slurry therethrough when actuated; and a controller responsive to the flowmeter means for controlling the rate of restriction of said valve means in such a way that flow rate of the slurry becomes about equal to that of water supplied to said water supply pipe means.

2. A propulsion pipe laying system according to claim 1 further comprising pinch valve means mounted within said slurry discharge pipe means for closing the same when fluid-operated and compressor means for selectively supplying compressed fluid to said pinch valve means.

3. A propulsion pipe laying system according to claim 2 further comprising another pinch valve means mounted within said water supply pipe means for closing the same when fluid-operated, said another pinch valve means being connected with said compressor means and operated by compressed fluid therefrom.

4. A propulsion pipe laying system according to claim 3 wherein each of said pinch valve means comprises a first cylinder mounted within either of said pipe means, a second resilient cylinder mounted within said first cylinder and a pair of retainer means each for retaining one end of said second resilient cylinder in fluid-tight manner against said first cylinder.

5. A propulsion pipe laying system including a pilot head having cutter means mounted at the leading end thereof and means for propelling said pilot head into the underground, comprising:

water supply pipe means mounted to said pilot head;

slurry discharge pipe means mounted to said pilot head;

a first tank containing water therein;

pump means for pumping water from said first tank and supplying the same to said water supply pipe means;

a second tank for receiving a slurry from said slurry discharge pipe means;

slurry conduit means connected to said slurry discharge pipe means for carrying the slurry to said second tank;

means for defining a receiving chamber in a leading end portion of said pilot head for receiving excavated earth and sand therein, said receiving chamber being communicated with leading ends of both said water supply pipe means and said slurry discharge pipe means;

differential pressure detector means mounted within said pilot head for detecting pressure difference between underground pressure at said cutter means and a pressure in said receiving chamber and generating a signal;

valve means disposed in said slurry conduit means for restricting flow rate of the slurry therethrough when actuated; and a controller responsive to the signal from said differential pressure detector means for controlling the rate of restriction of said valve means in such a way that the pressure in said receiving chamber becomes about equal to the underground pressure at said cutter means.

6. A propulsion pipe laying system according to claim 5 further comprising pinch valve means mounted within said slurry discharge pipe means for closing the same when fluid-operated and compressor means for selectively supplying compressed fluid to said pinch valve means.

7. A propulsion pipe laying system according to claim 6 further comprising another pinch valve means mounted within said water supply pipe means for closing the same when fluid-operated, said another pinch valve means being connected with said compressor means and operated by compressed fluid therefrom.

8. A propulsion pipe laying system according to claim 7 wherein each of said pinch valve means comprises a first cylinder mounted within either of said pipe means, a second resilient cylinder mounted within said first cylinder and a pair of retainer means each for retaining one end of said second resilient cylinder in fluid-tight manner against said first cylinder.

* * * * *